United States Patent [19]

Hewitt et al.

[11] Patent Number: 4,992,638

[45] Date of Patent: Feb. 12, 1991

[54] MICROWAVE HEATING DEVICE WITH MICROWAVE DISTRIBUTION MODIFYING MEANS

[75] Inventors: Bryan C. Hewitt; Melville D. Ball, both of Kingston, Canada

[73] Assignee: Alcan International Limited, Montreal, Canada

[21] Appl. No.: 518,324

[22] Filed: May 4, 1990

Related U.S. Application Data

[63] Continuation of Ser. No. 314,474, Feb. 22, 1989, abandoned.

[51] Int. Cl.[5] ..... H05B 6/80

[52] U.S. Cl. ..... 219/10.55 E; 219/10.55 F; 219/10.55 M; 426/107; 426/234; 426/243; 99/DIG. 14

[58] Field of Search ..... 219/10.55 E, 10.55 F, 219/10.55 M, 10.55 R; 426/107, 109, 110, 111, 113, 114, 241, 243, 234; 99/451, DIG. 14; 126/390

[56] References Cited

U.S. PATENT DOCUMENTS

| | | | |
|---|---|---|---|
| 2,600,566 | 6/1952 | Moffett, Jr. | 219/10.55 E |
| 2,612,596 | 9/1952 | Gross | 219/10.55 F |
| 3,662,141 | 5/1972 | Schauer, Jr. | 219/10.55 E |
| 3,845,266 | 10/1974 | Derby | 426/243 X |
| 4,019,009 | 4/1977 | Kusunoki et al. | 219/10.55 E |
| 4,223,194 | 9/1980 | Fitzmayer | 219/10.55 F |
| 4,320,274 | 3/1982 | Dehn | 219/10.55 E |
| 4,656,325 | 4/1987 | Keefer | 219/10.55 E |
| 4,661,672 | 4/1987 | Nakanaga | 219/10.55 F |
| 4,683,362 | 7/1987 | Yangas | 219/10.55 F |
| 4,698,472 | 10/1987 | Cox et al. | 219/10.55 E |
| 4,814,568 | 3/1989 | Keefer | 426/107 X |
| 4,866,234 | 9/1989 | Keefer | 219/10.55 E |
| 4,888,459 | 12/1989 | Keefer | 219/10.55 E |
| 4,927,991 | 5/1990 | Wendt et al. | 219/10.55 E |

FOREIGN PATENT DOCUMENTS

| | | | |
|---|---|---|---|
| 1202088 | 3/1986 | Canada . | |
| 1239999 | 8/1988 | Canada . | |
| 0185488 | 6/1986 | European Pat. Off. . | |
| 246041 | 11/1987 | European Pat. Off. | 219/10.55 E |
| 0271981 | 6/1988 | European Pat. Off. . | |
| 0317203 | 5/1989 | European Pat. Off. . | |

*Primary Examiner*—Philip H. Leung

*Attorney, Agent, or Firm*—Cooper & Dunham

[57] ABSTRACT

A container for heating a substance, e.g. food, in a microwave oven has a bottom transparent to microwave energy. The container is supported on a stand that contains one or more electrically conductive plates (or apertures in an electrically conductive sheet) that generate at least one mode of microwave energy of higher order than the fundamental modes. The stand also serves to support the container above the higher order mode generating plates (or apertures) so that the undersurface of the substance is spaced from them by a uniform predetermined distance. The arrangement has the known features of "bottom heating", i.e. taking advantage of the natural heat flow in the substance, while achieving more uniform heating of the substance by virtue of the higher order mode or modes. As an alternative to or in addition to the generation of higher order modes, the stand may embody elements that modify the microwave pattern in a manner than enhances the coupling of microwave energy into the undersurface of the substance to be heated.

50 Claims, 6 Drawing Sheets

MICROWAVE HEATING DEVICE WITH MICROWAVE DISTRIBUTION MODIFYING MEANS

This is a continuation of application Ser. No. 314,474, filed Feb. 22, 1989, now abandoned.

FIELD OF THE INVENTION

This invention relates to improvements in the heating of substances in a microwave oven. While the substances most commonly heated will be foodstuffs, and the examples below will therefore relate to foodstuffs, the present invention is not limited in this respect and can be used for heating other substances.

BACKGROUND OF THE INVENTION

In normal microwave transparent containers, the microwave energy can enter through the top, bottom and sides of the container. This is similar to the situation encountered during conventional oven cooking (or heating). With normal microwave foil containers the microwave energy can only enter through the top (food surface).

Prepared foods are commonly reheated in a cooking utensil on a stove top. One characteristic of this type of reheating is that the heat enters the food through the bottom of the container/utensil.

Heating the food from the bottom offers some advantages, as a result of the heat transfer mechanisms that take place. The food in contact with the base heats and becomes less dense. This provides a driving force for convective transport, the warm food rising and being replaced by cooler food from nearer the surface. The extent of this convection depends on the viscosity of the food. At a later stage of heating, bubbles of steam nucleate at or near the base and rise through the food. This transfers heat throughout the food as well as agitating the product.

PRIOR ART

With a view to simulating this type of "bottom heating" in a microwave oven, there has been proposed in R. Nakanaga U.S. Pat. No. 4,661,672 issued Apr. 28, 1987, a rectangular container having a microwave energy shielding layer extending over the top and down at least the upper portions of the side walls, while the remainder, and particularly the bottom of the container, was made of a microwave transparent material. In this way, the microwave energy is caused to enter the container through its bottom, and possibly to some extent through the lower parts of the side walls. This prior patent also discloses the feature of elevating the container so that its bottom is spaced above the floor of the microwave oven. A similar arrangement is disclosed in K. Sugisawa et al European patent application No. 0,185,488 published June 25, 1986, although in this case the top of the container is only shielded at its edges, whereby to avoid excessive heating of the upper surface of the material located at the sides of the container.

For food loads that have low viscosity and hence allow substantial heat transfer by convection, conventional containers will often perform satisfactorily. However, in many cases the characteristic non-uniform heating that results from the dominant fundamental energy distribution will not be sufficiently equalised by convective heat transfer, and an unsatisfactory product will result. In particular, there will tend to be excessive heating at the edges and insufficient heating in the middle of the body of food. Viscous products such as meat stews or casseroles, lasagna, macaroni cheese, thick soups and chowders are particularly difficult in this respect.

SUMMARY OF THE INVENTION

The object of the present invention is to minimize this difficulty, and in particular, to provide an arrangement in which the food product (or other substance) is not only heated at its undersurface (although not necessarily only at its undersurface), but is also heated more rapidly and/or more uniformly across its lateral dimensions.

To this end, the present invention provides a stand for use with a container having at least one portion transparent to microwave energy including a bottom on which there is supported an undersurface of a substance to be heated. The stand comprises means for modifying the microwave field pattern to which the container is exposed, and means for supporting the container spaced above such modifying means so that the undersurface of the substance is maintained at a predetermined distance from such modifying means.

In the preferred form of the invention, the modifying means takes the form of means for generating a modified microwave field pattern having at least one mode of microwave energy of higher order than the fundamental modes of such energy.

Higher order mode generating means are known per se. See, for example, R. Keefer Canadian patent application Ser. No. 485,142 filed June 25, 1985 now Canadian patent No. 1,239,999 issued Aug. 2, 1988 (U.S. patent application Ser. No. 878171 filed June 5, 1986 now U.S. Pat. No. 4,866,234 issued Sept 12, 1989 and European patent application No. 86304880 filed June 24, 1986 and published Dec. 30, 1986). Such higher order mode generating means may take the form of one or more electrically conductive plates (or apertures in an electrically conductive sheet) arranged in a symmetrical planar array. Examples of such structures are discussed below.

The term "mode" is used in the specification and claims in its art-recognized sense, as meaning one of several states of electromagnetic wave oscillation that may be sustained in a given resonant system, each such state or type of vibration (i.e., each mode) being characterized by its own particular electric and magnetic field configurations or patterns. The fundamental modes of the container and body are characterized by an electric field pattern (power distribution) confined or concentrated around the edge of the container (as viewed in a horizontal plane), these fundamental modes predominating in a system that does not include any higher order mode-generating means. The fundamental modes are defined by the geometry of the container and the contained body of material to be heated.

A mode of a higher order than that of the fundamental modes is a mode for which the electric field pattern (again, for convenience of description, considered as viewed in a horizontal plane) is concentrated around the periphery of an area smaller than that circumscribed by the electric field pattern of the fundamental modes. Each such electric field pattern may be visualized, with some simplification but nevertheless usefully, as corresponding to a closed loop in the horizontal plane.

Alternatively, or additionally, the modifying means may take the form of means for enhancing the coupling of microwave energy into the undersurface of the substance to be heated. Such coupling enhancement means are more fully described below.

In addition to its microwave transparent portion or portions, the container may have some portions that are reflective of microwave energy. When bottom heating is to be the dominant mode of heating, the transparent portions will be principally constituted by the bottom of the container. Thus, in one embodiment, the lid and side walls of the container can be reflective of the microwave energy, while the bottom is transparent to such energy, so that all the energy enters the food by its undersurface. There may, however, be instances where it will be convenient to allow some of the microwave energy to enter the food through areas other than the undersurface, and such an arrangement is not excluded by the present invention. For example, some foods such as baked goods, or those having a surface layer needing to be melted, e.g. a cheese layer on lasagna, or a potato layer on shepherd's pie, are ideally heated at the top and the bottom simultaneously. In this case the container lid can be microwave transparent, or can simply be removed during the heating process. Nevertheless, in the preferred embodiments of the invention, the majority of the microwave energy will enter through the undersurface of the container to maximize the bottom heating effect, the advantages of which have been discussed above.

In addition, the invention does not exclude the possibility that may be desirable in some instances, namely that parts of the bottom of the container, for example the peripheral edge of such bottom, can be shielded, so as to concentrate the microwave energy in the central portion of the undersurface of the substance being heated.

Finally, it should be mentioned that, in those examples where it is desired to avoid microwave energy entering the food at its lateral edges, the stand can include upwardly projecting metallic parts that shield these lateral edges, thus avoiding the need for the container itself to have reflective side walls.

In one preferred form of the invention, the container will have a flat bottom, the field modifying means will be planar, and the supporting means will be so dimensioned as to support this flat bottom in a plane parallel to the field modifying means. As a result a predetermined spacing between the container bottom and the field modifying means is maintained uniform throughout the lateral dimensions of the container.

The invention also consists of the combination of a stand as described above and a container for holding the substance to be heated. This combination can consist of two separate elements that are brought together for use, with the stand being available for reuse with the same or another container. Alternatively, these two elements can be joined together and sold as a single assembly, either for single or multiple use. For multiple use the combination will constitute a permanent cooking vessel.

The shape of the container may be that of a conventional tray in which frozen food is commonly sold, i.e. a relatively shallow, rectangular or round tray with a flat bottom, side walls and a flat removable lid. However, one of the advantages of bottom heating, is that the normal limitations on product depth are much less important. Since other heat transfer mechanisms (convection, steam bubbles) are being encouraged, deeper loads (similar to those which would be used in a stove top saucepan) can be satisfactorily dealt with. This represents a real advantage. It is also worth noting that microwave heating from the bottom will be better than normal stove top heating, because the penetration of the microwave heating obviates the need to stir the product. In normal stove top cooking, the heat energy is transferred to the food through the base by conduction. Rapid heating of the food normally requires the temperature of the base of the utensil to be raised to a high temperature. To avoid burning the food in contact with the base, low power settings can be used (which extend the heating time) or, alternatively, the food must be stirred frequently (for viscous foods).

In a method aspect, the invention can be defined as the provision in a method of heating a substance by microwave energy, of the steps of confining such substance in a partially shielded container that is of such a nature that at least some and preferably the majority of the energy enters the substance through its undersurface, while modifying the microwave field pattern by means located a predermined distance below such undersurface to enhance the coupling of microwave energy into such undersurface and/or to improve the uniformity of heating in the lateral dimensions.

DETAILED DESCRIPTION OF THE PREFERRED EMBODIMENTS

Figure 1:
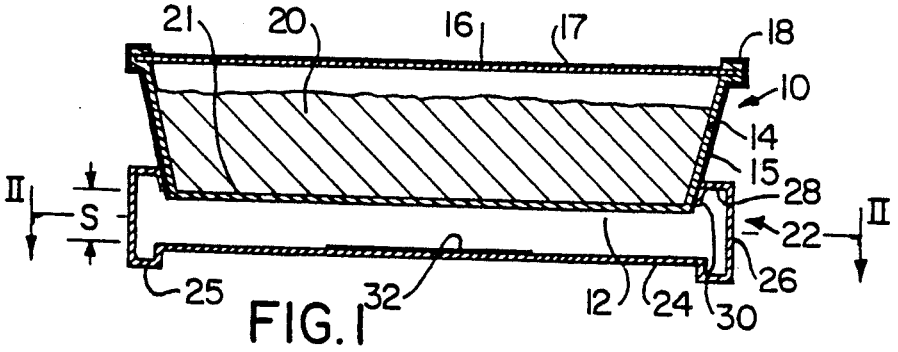
FIG. 1 shows a vertical central section of an assembly of a container and a stand therefor, according to an embodiment of the invention.
Figure 2:
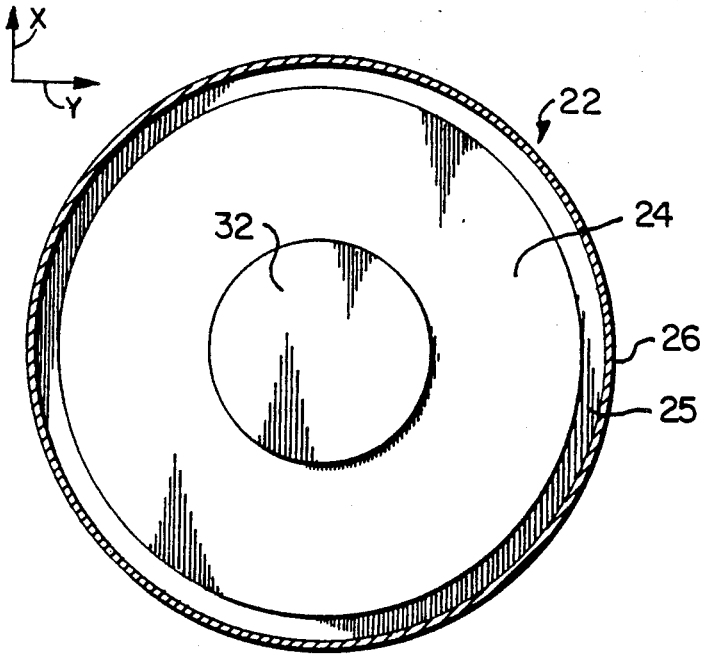
FIG. 2 is a section on II—II in FIG. 1.

FIGS. 1 and 2 show a container 10 having a bottom 12 of a suitable microwave transparent material, e.g. fiberboard or a plastic material, side walls 14 of metal foil or of a laminate containing metal foil 15, and a lid 16 also of metal foil or of a fiberboard laminate including metal foil 17, the lid being held in place by a fold down rim 18. The design of the lid and rim is such that there is no possibility of arcing. A food load 20 is supported in the container with its undersurface 21 on the bottom 12. This container 10 can be circular, rectangular, or any other convenient shape in plan view. In FIGS. 1 and 2, it has been assumed that the container 10 is circular.

Figure 2A:
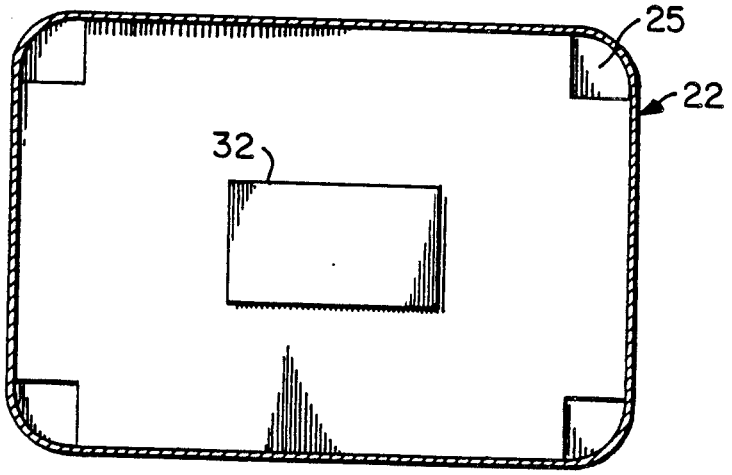
FIG. 2A is a modification of FIG. 2.

FIG. 2A shows a rectangular stand for a rectangular container.

The cooking assembly includes a stand 22 on which the container 10 is designed to be seated, such stand 22 consisting of a base 24, side walls 26 and a rim 28 with an inwardly sloping portion 30, all made of a microwave transparent material. The base 24 is formed with either a continuous peripheral depression or a series of such depressions forming feet 25 that serve to elevate the base 24. Centrally of the base 24, there is a plate 32 of conducting material, e.g. aluminum, that will serve to modify the microwave field pattern and generate the higher order modes. In FIG. 2, the plate 32 is circular; in FIG. 2A it is rectangular. The dimensions of the stand 22 are such that the spacing S between the undersurface 21 of the food load 20 and the upper surface of the plate 32 is set at an optimum value for the conditions. The choice of the value for this spacing S is discussed below. Since the undersurface of the food into which the microwave energy is being propagated lies in continuous contact with the bottom 12 of the container, this spacing S is uniform across the lateral dimensions X and Y of the container.

The stand 22 may be a reusable kitchen appliance that is constructed of a sturdy plastic or glass, or it may be a more cheaply made disposable element that is sold with the container 10 either as a separate item to be assembled in the oven or as a fixture secured to the bottom of the container 10.

Figure 3:
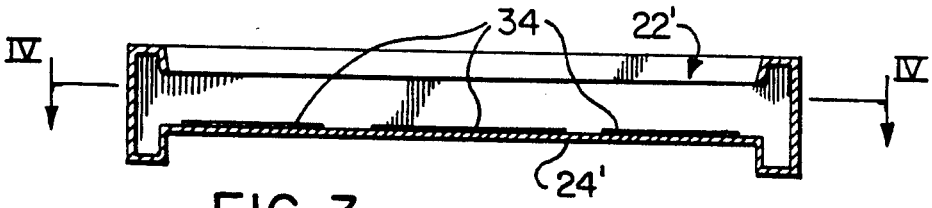
FIG. 3 is a vertical central section of a modified stand according to a further embodiment of the invention.

The size and arrangement of the plate 32 centrally of the base 24 in FIGS. 1 and 2, is similar to arrangements of conducting plates shown in the Keefer patent application referred to above. If it is preferred to generate still higher order modes of microwave energy at the bottom 12 of the container, an array of a larger number of smaller plates 34 can be provided on the base 24' of a modified stand 22' shown in FIGS. 3 and 4 and designed for use with a rectangular container, this array of plates 34 being generally similar to that shown mounted on a container lid in FIG. 10B of said Keefer patent. This latter arrangement is well suited to the heating of relatively shallow food loads, since the higher order modes may not penetrate as far into the food load as the fundamental modes. On the other hand, they achieve enhanced uniformity of heating across the lateral dimensions of the container.

Figure 4:
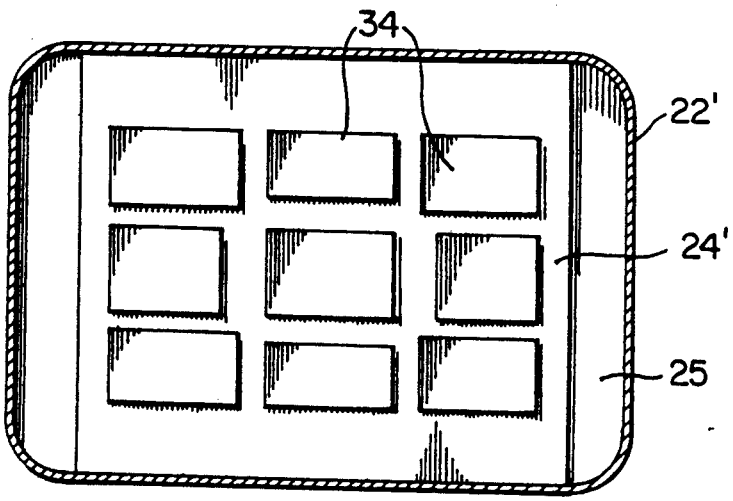
FIG. 4 is a view on IV—IV in FIG. 3.
Figure 4A:
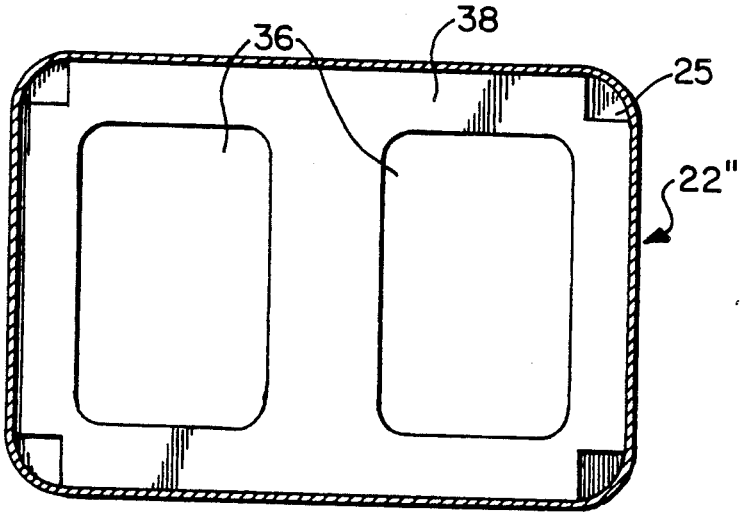
FIG. 4A is a modification of FIG. 4.

As explained in the Keefer patent application, an array of plates, such as the plates 34, can be replaced by an array of apertures in a metallic sheet that otherwise covers the surface. FIG. 4A shows a suitable array of apertures 36 in a conductive plate 38 on the base of a stand 22'', or the whole stand may be conductive, e.g. made of aluminum.

Figure 5:
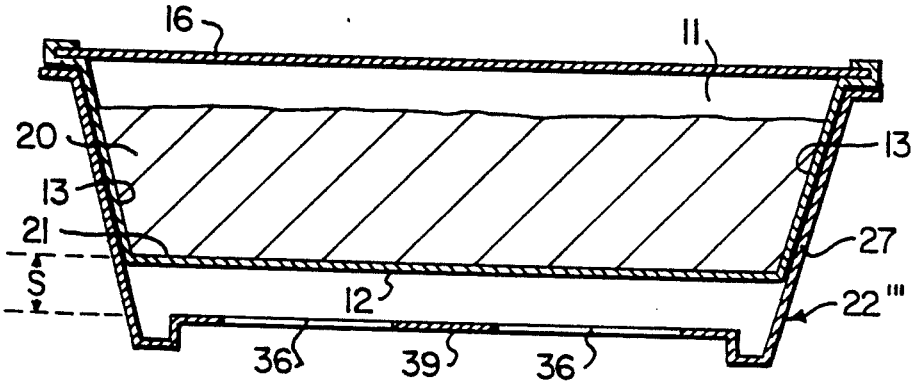
FIG. 5 shows a view similar to FIG. 1 of an alternative embodiment.

FIG. 5 shows a further modification in which a stand 22 made of aluminum has upwardly extended sloping end and side walls 27, and a base 39 containing apertures 36. A container 11 with a food load 20 has end walls 13 that nest snuggly within the walls 27 to support the container with its bottom 12 and hence the undersurface 21 of the food load a predetermined distance S above the base 39. The container 11 has a lid 16. In this arrangement the metallic walls 27 of the stand provide lateral shielding for the food load, so that the container 11 can be made entirely of a microwave transparent material. The lid 16 may be metallic, if top shielding is required, or microwave transparent, if such shielding is not required, or some combination thereof, if partial shielding is required.

Figure 6:
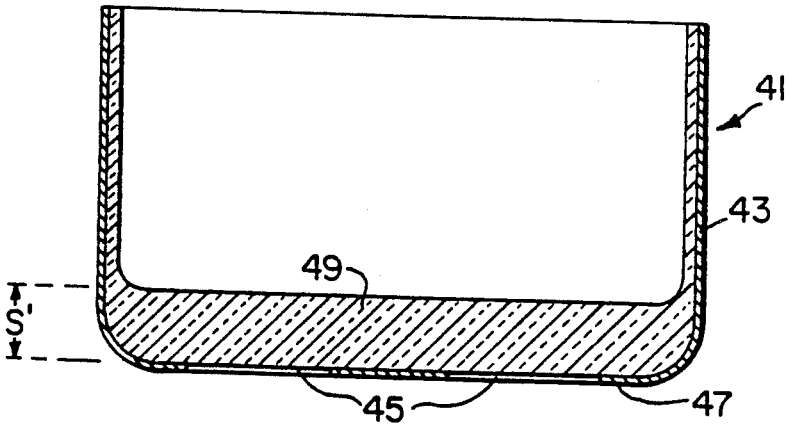
FIG. 6 is a similar view of yet another embodiment.

FIG. 6 shows an application of a somewhat similar construction, as applied to a reusable cooking vessel 41 made of glass with a metallised outer surface layer 43 having apertures 45 in the portion 47 thereof that extends across the bottom surface of the bottom portion 49. This bottom portion 49 of the utensil 41 is relatively thick compared to its sides whereby to provide the necessary spacing S' between its upper bottom surface that supports the undersurface of the food load (not shown) and its bottom surface 47.

Figure 7:
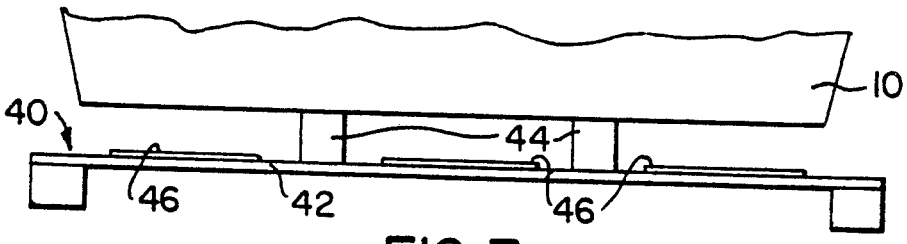
FIG. 7 is a side view of an alternative form of stand.

FIG. 7 shows an alternative arrangement in which a stand 40 consists of a flat base 42 supporting four posts 44 on which the container 10 is placed. Conductive plates 46 are located on the upper surface of the base 42 for generating the higher order modes.

Figure 8:
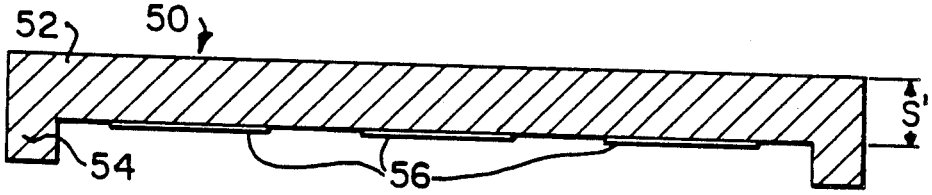
FIG. 8 is a side view of a still further alternative form of stand.

FIG. 8 shows another construction of stand 50 made of a solid plastic or glass slab 52 on the upper surface of which the container 10 will be placed. Legs 54 hold the slab 52 above the oven floor, and conductive plates 56 are secured to the underside of the slab 52.

Figure 9A:
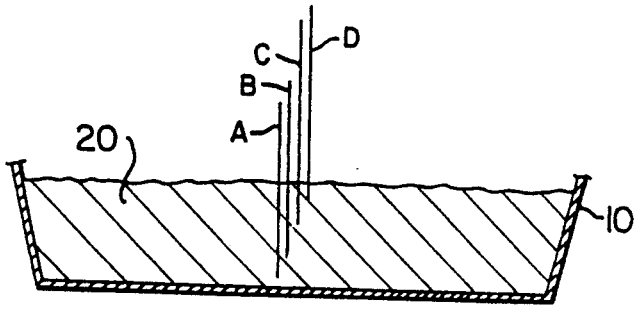
FIGS. 9A and 9B are diagrams illustrating the positions of temperature sensors used in the tests illustrated in FIGS. 10 and 11.
Figure 9B:
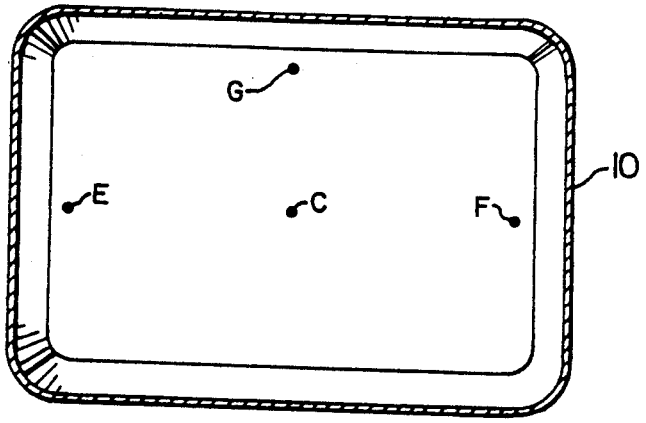
Figure 10:
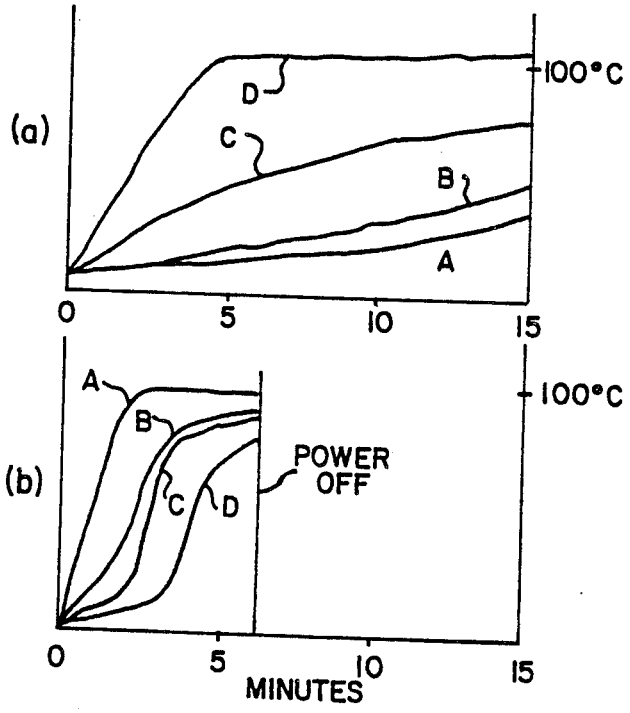
FIGS. 10(*a*) and (*b*), and 11(*a*) and (*b*) are comparative graphs comparing the performance of different arrangements.
Figure 11:
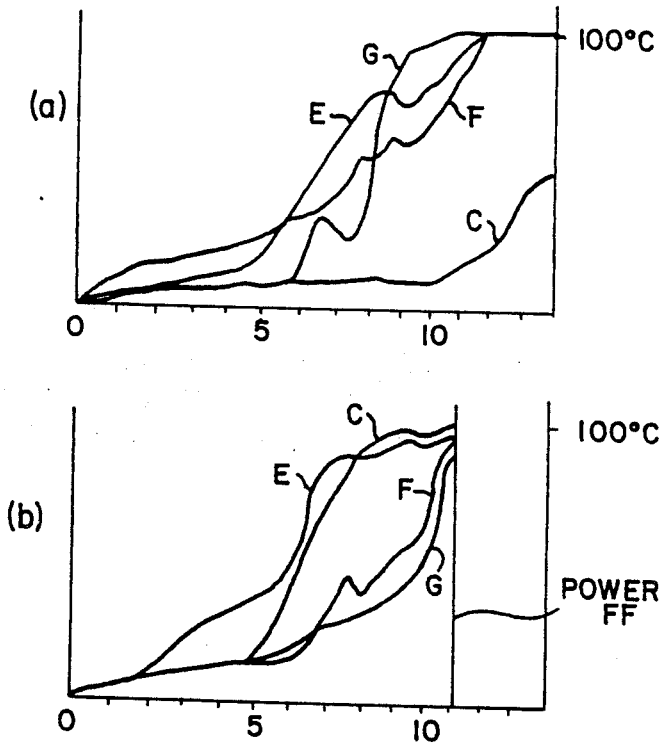

FIGS. 9A and 9B show how the tests reproduced in FIGS. 10 and 11 were conducted. As shown in FIG. 9A, four temperature probes A, B, C, D were inserted into the food load 20, approximately centrally of both lateral dimensions of the container, and at varying depths, probe A being nearest the undersurface of the food and probe D nearest the top surface. FIG. 9B shows the locations of four temperature probes C, E, F, G inserted into the food load, all at the same depth, i.e. at approximately one quarter depth, and respectively located at approximately the center, the left end, the right end and the side (located at the back when placed in the microwave oven) of the container.

FIG. 10(*a*) shows the temperatures measured by probes A–D when heating a load of about 680 grams of canned beef and vegetable stew for 15 minutes in a 700 watt microwave oven in a conventional circular foil container, i.e. one having the following dimensions: outside top diameter 181 mm; inside top diameter 171 mm; bottom diameter 140 mm; slant depth 38 mm; and capacity 796 ml.

FIG. 10(*b*) shows the same experiment when conducted in a similar container modified to make the lid and sides microwave reflective and the bottom microwave transparent, and mounted on a stand as shown in FIG. 2 having a single circular aluminum plate 32 with a diameter of 55 mm.

The results illustrate dramatically how the more uniform heating of the invention enables all levels in the food to assume an acceptable temperature, i.e. at least 80° C., within 6 minutes, in contrast to the 15 minutes of FIG. 10(*a*).

FIGS. 11(*a*) and (*b*) respectively show the readings obtained from probes C, E, F and G in a rectangular container having the following dimensions: outside top 146×121 mm; inside top 130×105 mm; bottom 115×89 mm; slant depth 38 mm; and capacity 455 ml. The first test was conducted with a microwave transparent base, but no higher order mode generating stand (FIG. 11(*a*)), and then with such stand (FIG. 11(*b*)). The load was about 400 grams of a frozen Chili-con-Carne product. FIG. 11(*a*) shows that the outer regions of the product had thawed and heated to an acceptable temperature (60° C.) in nine–ten minutes, while the central region was still frozen until after about eleven minutes had elapsed. Acceptable temperatures were not achieved in the central region until after about 15 minutes. It should be noted that, at this time, some regions around the edge of the container had been boiling for about five minutes, which is undesirable. The erratic temperature variations during the rapid heating part of the curves are indicative of turbulence caused by bubbles of steam rising through the product.

In the equivalent container used in conjunction with a higher order mode generating stand (FIG. 10(*b*)), the heating behaviour obtained is very different. The mode generating device in this case was a single foil block as shown in FIG. 2A, the block being rectangular, 55×30 mm. In this case it is noticeable that the center region thawed and heated in a much shorter time than before. Furthermore, the overall heating behaviour is noticeably more uniform. Thus the fastest region to heat was only boiling for about one minute before all the measured temperatures had reached an acceptable temperature (60° C.).

In another test (not illustrated) when using a standard container, the initial weight of a load of Chinese style chicken fried rice that had been pre-cooked and frozen was 330.8 grams and its final weight was 239.5 grams, for a weight loss of 91.3 grams, i.e. 27.6%, over a ten minutes heating time. In a corresponding test when the container was placed on a stand as shown in FIG. 4, the initial weight was 329.5 grams and the final weight 318.8 grams, for a weight loss of 10.7 grams, or 3.2%, over a seven minutes heating time which was all that was necessary. This reduced weight loss is a further advantage of the present invention.

Figure 12:
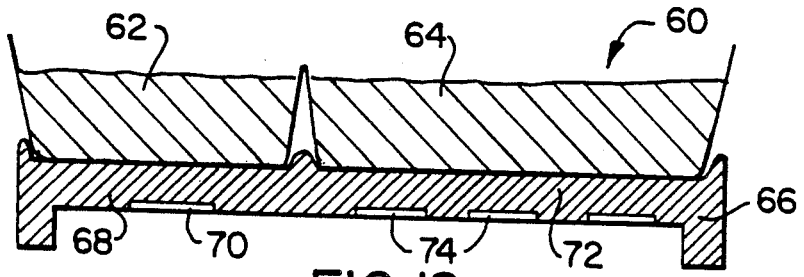
FIG. 12 is a vertical central section illustrating an application of the invention to a multi-compartment container.

FIG. 12 illustrates how a multi-compartment container 60 having two different food loads 62, 64 can be mounted on a common stand 66. Depending on the different natures of the two food loads and the amount of microwave energy that it is desired they should each absorb, the conditions can be adjusted appropriately. For example, the portion 68 of the stand 66 situated below the food load 62 may employ a single higher order mode generating conductive plate 70, while the portion 72 situated below the food load 64 may employ multiple plates 74. Alternatively, in an example not illustrated, one of the portions of the stand 66 may not include any means for generating higher order modes and the food load associated with such portion may be entirely shielded from the microwave energy. This latter arrangement would be especially appropriate if the fully shielded food load is required to remain cold.

As far as spacing is concerned, there will be a requirement for a certain minimum spacing between the conducting plates (or foil surround, in the case of apertures) and the metal of the oven floor, in order to avoid arcing. It is for this reason that the embodiment of FIG. 1, and many of the other embodiments, are provided with feet 25. However, if the oven has a sufficiently thick glass tray on its floor, or a separate microwave transparent rack is used, such feet can be dispensed with, e.g. the vessel of FIG. 6. Such arcing-avoidance spacing will typically be required to be at least 3 mm. It should also be mentioned that, in a case where the stand is not provided with feet and is placed directly on a glass tray on the oven floor, i.e. with mainly glass and little air between the conducting material and the oven floor, the array of plates or apertures may require dimensional modification to take into account the dielectric constant of the glass.

The following considerations should be taken into account when selecting the preferred value for the spacing between the undersurface of the food and the field modifying means, i.e. the spacing S when in air (FIG. 1 or 5) or S' when in a plastic or glass material (FIG. 6 or 8).

The optimum spacing will depend in part on the properties of the foodstuff (for example, the dielectric properties will change the phase shift which occurs on reflection). A possible range for the spacing S in air is from about 3 to 30 mm. A spacing S of 15 mm (with air separating the foil structure from the container base) has been successfully used in practice. As indicated, this spacing will depend on the dielectric constant of the material between the foil array and the bottom of the food load. The following table gives examples of modifications to the 15 mm spacing that would be appropriate if materials of different dielectric constant were present between the bottom of the food and the foil array structure. Specifically, the table shows that the spacing S' for a medium other than air separating the foil structure from the container base is the corresponding spacing S for air divided by the square root of the dielectric constant of the medium.

| Material | Dielectric Constant (Relative Permittivity) | Spacing S or S' |
|---|---|---|
| Air | 1.0 | 15 mm |
| Silica Glass | 3.78 | 7.72 mm |
| Polyethylene | 2.25 | 10 mm |
| Plexiglass | 2.6 | 9.3 mm |

Tests have also been carried out to measure the effect of the invention on total power absorption. A rectangular container (with a microwave transparent base) and a stand with the 9-block foil array structure as in FIG. 4 was used. Power measurements were made using water as the load.

Test 1—Container placed directly on the oven glass plate.

Measured power—271.5 watts

Test 2—Container raised 30 mm above the glass plate (no foil array)

Measured power—268.2 watts

Test 3—Container raised 30 mm above the glass plate (with the 9-block array as in FIG. 4 located midway, i.e. 15 mm from the tray and 15 mm from the food undersurface).

Measured power—307.2 watts

This corresponds to an improvement in power absorption of approximately 13%. Increased power absorption is useful (reduced cooking time), in addition to the improvement in heating uniformity that many of the embodiments of the present invention provide.

In the examples described so far it has been assumed that the stand will have a flat bottom. It is, however, within the scope of the invention to employ a stand embodying higher order mode generating means incorporating a stepped structure, e.g. a stepped structure of one of the types disclosed in R. Keefer Canadian patent applications Serial Nos. 508,812 filed May 9, 1986; 536,589 filed May 7, 1987; and 544,007 filed Aug. 7, 1987 (U.S. patent applications Ser. Nos. 943,563 filed Dec. 18, 1986 and 044,588 filed Apr. 30, 1987 and European patent applications Nos. 87304120.6 filed May 8, 1987 and published Nov. 19, 1987, under No. 246041 and 87309398.3 filed Oct. 23, 1987 and published June 22, 1988 under No. 271981). Some patent applications just referred to also disclose a container having a wall (e.g. a bottom wall) having a modified portion that has a different electrical thickness from that of adjacent portions of the wall, the electrical thickness being defined as a function of the actual spatial thickness of the wall and the dielectric constant of the wall material. Such a wall structure comprising appropriately arranged contiguous wall portions of respectively different electrical thicknesses can serve to generate at least one mode of a higher order than the fundmental modes. In the present invention, higher order mode generating means located in the stand can utilize such an arrangement of various portions of differing electrical thickness instead of the foil plates or apertures described above.

Figure 13:
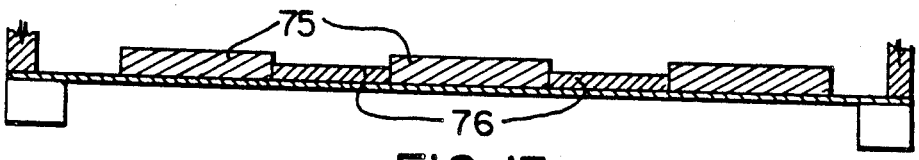
FIGS. 13 to 15 each show alternative stand constructions.
Figure 14:
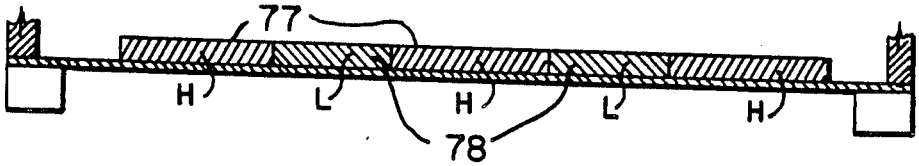

FIG. 13 shows a stand with such a structure based on portions 75, 76 of different physical thickness, while FIG. 14 shows a structure in which portions 77, 78 have the same physical thickness, but a different electrical thickness by virtue of having different dielectric constants, respectively designated L and H for low and high.

Figure 15:
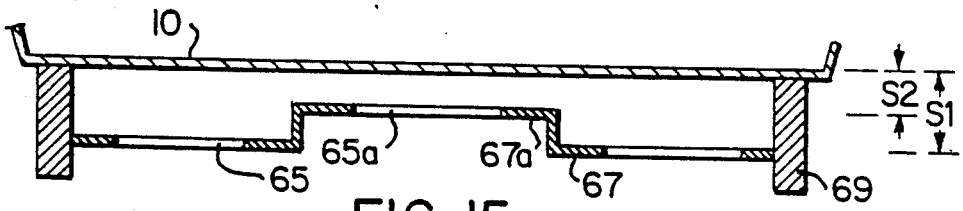
Figure 15A:
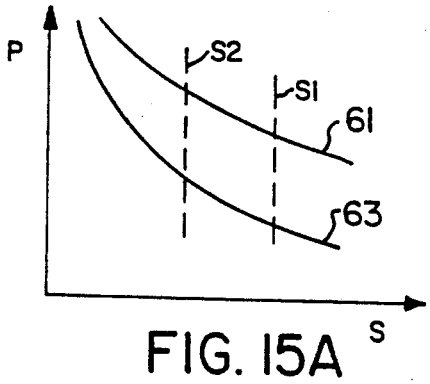
FIG. 15A is a graph related to FIG. 15.
Figure 16:
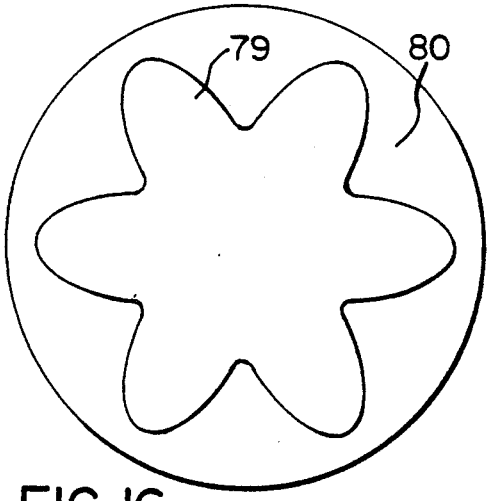
FIGS. 16 to 18 each show still further alternative stand constructions.

FIG. 15 shows a structure in which apertures 65 are formed in a conducting base 67 supported by non-conducting supports 69, a central aperture 65*a* being formed in a raised portion 67*a* of the base, whereby its distance S2 from the undersurface of a food load (not shown) in a container 10 is less than the distance S1 of the remainder of the base 67. FIG. 15A shows the effect on the power P conveyed to the load as a function of S. Curve 61 is for larger apertures 65, while curve 63 is for smaller apertures.

A plan view of FIG. 13, 14 or 15 would show the portions 75, 76 or 77, 78, or the apertures 65, forming a nine block array similar to FIG. 4, although this array can be modified as required.

As a further alternative, the higher order mode generating means employed in a stand according to the present invention can take the form shown used on a container in R. Keefer U.S. patent application Ser. No. 051078 filed May 15, 1987 now U.S. Pat. No. 4,814,568 issued Mar. 21, 1989 (Canadian application filed May 12, 1988). This alternative is illustrated by the plan view of a circular stand in FIG. 15 where the portion is a shaped piece of foil on a microwave transparent base 80.

Figure 17:
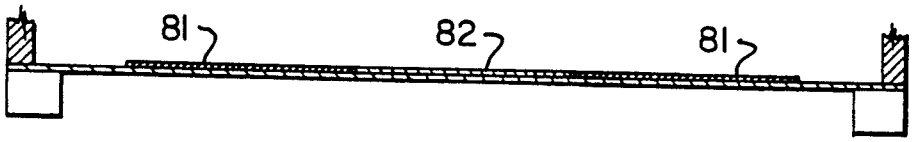

Higher order modes of microwave energy can also be generated by a stepwise discontinuity of lossiness between a pair of regions of a susceptor. Such a susceptor, which may constitute a separate element or may form a wall component of a container, is disclosed in R. Keefer Canadian patent application Serial No. 552,110 filed Nov. 18, 1987 European application No. 88310658.5 published May 24, 1989 under No. 317023). In accordance with the present invention such a susceptor structure can be used in the stand to provide higher order mode generating means, as well as to generate heat that can be conveyed to the container and the food or other material therein. Such a structure is shown in FIG. 17, where the portions 81 and 82 have different lossiness. A plan view of FIG. 17 could show the portions 81, 82 as a single block array, similar to FIG. 2 or 2A, or the portions 81, 82 could be strips extending fully across a rectangular container.

Figure 18:
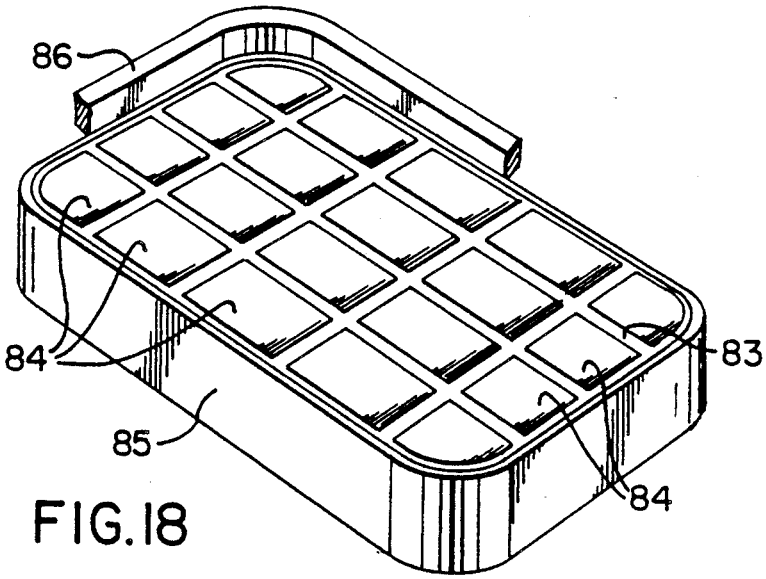

An arrangement for retaining and concentrating microwave energy in a container, i.e. enhancing the coupling of such energy into the container, is described in R. Keefer Canadian patent No. 1,228,126 issued Oct. 13, 1987 (U.S. Pat. No. 4,656,325 issued Apr. 7, 1987). A similar arrangement can be embodied in a stand in accordance with the present invention, as illustrated, for example in FIG. 18 which shows a stand with a substrate 83 of a dielectric material having a relatively low dielectric loss factor, e.g. polyethylene polyester film. On this substrate 83 there is an array of conductive plates or islands 84, e.g. aluminum foil. The total surface area of the metallic islands should preferably be between 50 and 80% of the surface area of the substrate. FIG. 18 shows the substrate 83 on a stand having a foot portion 85 and a rim 86 for supporting a container. The dielectric substrate 83 and the array of conductive plates should cooperatively provide a dielectric constant greater than 10, and the spacing between such array and the undersurface of the substance to be heated in the container (not shown) should be between one-fifteenth and one-sixth of the wavelength of the microwave energy, which is approximately between 8 and 20 mm in air. This arrangement may also serve at the same time to generate some higher order modes of microwave energy. However, in view of the relatively large number of plates 84 used in the 20-block array shown in FIG. 18, the height of the higher order modes will be greater than that of the modes generated by the single and nine-block arrays illustrated in other views. These very high order modes will penetrate a shorter distance into the food, and hence the advantage of the FIG. 18 embodiment flows more from the increased coupling of energy into the food than from higher order mode generation, although the latter phenomenon will contribute to some extent to the overall improvement in performance.

We claim:

1. A stand for use in a microwave oven having a microwave field pattern for use with a container having at least one portion including a bottom portion transparent to microwave energy, on which bottom portion there is supported an undersurface of a substance to be heated, said stand comprising (a) means for modifying said microwave field pattern to cause at least one mode of microwave energy of higher order than the fundamental modes of such energy to propagate in said substance to provide by means of such higher order mode a significant portion of the heating of said substance, and (b) means for supporting the container spaced above said modifying means so that said undersurface is a distance of at least 3 mm above said field modifying means.

2. A stand according to claim 1, wherein said modifying means is planar and said supporting means is dimensioned to support a flat bottom of the container lying in a plane parallel to said modifying means.

3. A stand according to claim 2, wherein said modifying means comprises at least one plate of electrically conductive material lying in a plane parallel to said bottom.

4. A stand according to claim 3, including means for spacing said electrically conductive material from an oven floor.

5. A stand according to claim 2, wherein said modifying means comprises an array of a plurality of plates of electrically conducting material lying in a plane parallel to said bottom.

6. A stand according to claim 2, wherein said modifying means comprises at least one aperture in a sheet of electrically conductive material lying in a plane parallel to said bottom.

7. A stand according to claim 2, wherein said modifying means comprises an array of a plurality of apertures in a sheet of electrically conductive material lying generally in a plane parallel to said bottom.

8. A stand according to claim 7, wherein at least one of said apertures is in a portion of said sheet located at a distance from said undersurface different from the distance of the remainder of said sheet from said undersurface.

9. A stand according to claim 1, wherein said modifying means comprises portions having different electrical thicknesses from one another.

10. A stand according to claim 9, wherein said portions have different physical thicknesses from one another.

11. A stand according to claim 9, wherein said portions have different dielectric constants from one another.

12. A stand according to claim 1, wherein said modifying means comprises portions having different lossinesses from one another.

13. A stand according to claim 1, wherein the stand includes upwardly extending, conductive outer portions for shielding side walls of the container.

14. A stand according to claim 1, wherein said predetermined distance is in the range of 3 to 30 mm.

15. A stand according to claim 14, wherein the space between the modifying means and the container bottom is air and said distance is approximately 15 mm.

16. A stand according to claim 14, wherein the space between the modifying means and the container bottom is polyethylene and said distance is approximately 10 mm.

17. A stand according to claim 14, wherein the space between the modifying means and the container bottom is glass and said distance is in the range from 7 to 10 mm.

18. A stand for use in a microwave oven for use in combination with a container having at least one portion including a bottom portion transparent to microwave energy, on which bottom portion there is supported an undersurface of a substance to be heated, said stand comprising (a) means for enhancing the coupling of microwave energy into the undersurface of said substance, and (b) means for supporting the container spaced above said coupling enhancement means so that said undersurface is a distance of between one-fifteenth and one-sixth of the wavelength of the microwave energy in the medium between the container and the coupling enhancement means above said coupling enhancement means, (c) wherein said coupling enhancement means comprises a substrate of dielectric material with an array of conductive plates covering at least the majority of the surface area of said substrate, the substrate and the plates cooperatively providing a dielectric constant greater than 10.

19. A stand according to claim 18, wherein said predetermined distance is in the range 8 to 20 mm.

20. In combination (a) a container for use in a microwave oven having a microwave field pattern, said container having at least one portion including a bottom portion transparent to microwave energy, on which bottom portion there is supported an undersurface of a substance to be heated, and (b) a stand for such container comprising means for modifying said microwave field pattern, to cause at least one mode of microwave energy of higher order than the fundamental modes of said energy to propagate in said substance to provide by means of such higher order mode a significant portion of the heating of said substance, and means for spacing said container bottom above said modifying means so that said undersurface is a distance of at least 3 mm above said modifying means.

21. The combination of claim 20, wherein said modifying means is planar and said supporting means is dimensioned to support a flat bottom of the container lying in a plane parallel to said modifying means.

22. The combination of claim 21, wherein said modifying means comprises at least one plate of electrically conductive material lying in a plane parallel to said bottom.

23. The combination of claim 22, including means for spacing said electrically conductive material from an oven floor.

24. The combination of claim 21, wherein said modifying means comprises an array of a plurality of plates of electrically conducting material lying in a plane parallel to said bottom.

25. The combination of claim 21, wherein said modifying means comprises at least one aperture in a sheet of electrically conductive material lying in a plane parallel to said bottom.

26. The combination of claim 21, wherein said modifying means comprises an array of a plurality of apertures in a sheet of electrically conductive material lying generally in a plane parallel to said bottom.

27. The combination of claim 26, wherein at least one of said apertures is in a portion of said sheet located at a distance from said undersurface different from the distance of the remainder of said sheet from said undersurface.

28. The combination of claim 20, wherein said modifying means comprises portions having different electrical thicknesses from one another.

29. The combination of claim 28, wherein said portions have different physical thicknesses from one another.

30. The combination of claim 28, wherein said portions have different dielectric constants from one another.

31. The combination of claim 20, wherein said modifying means comprises portions having different lossinesses from one another.

32. The combination of claim 20, wherein said container has portions reflective of microwave energy, said at least one transparent portion being principally constituted by the bottom of the container.

33. The combination of claim 32, wherein said container has reflective side walls and lid.

34. The combination of claim 20, wherein the stand includes upwardly extending, conductive outer portions for shielding side walls of the container.

35. The combination of claim 20, wherein said pre distance is in the range of 3 to 30 mm.

36. The combination of claim 35, wherein the space between the modifying means and the container bottom is air and said distance is approximately 15 mm.

37. The combination of claim 35, wherein the space between the modifying means and the container bottom is polyethylene and said distance is approximately 10 mm.

38. The combination of claim 35, wherein the space between the modifying means and the container bottom is glass and said distance is in the range from 7 to 10 mm.

39. In combination (a) a container for use in a microwave oven having at least one portion including a bottom portion transparent to microwave energy, on which bottom portion there is supported an undersurface of a substance to be heated, and (b) a stand for such container comprising means for enhancing the coupling of microwave energy into the undersurface of said substance, and means into spacing said container bottom above said coupling enhancing means so that said undersurface is a distance of between one-fifteenth and one-sixth of the wavelength of the microwave energy into the medium between the container and the coupling enhancement means above said coupling enhancing means, (c) wherein said coupling enhancement means comprises a substrate of dielectric material with an array of conductive plates covering at least the majority of the surface area of said substrate, the substrate and the plates cooperatively providing a dielectric constant greater than 10.

40. The combination of claim 39, wherein said predetermined distance is in the range 8 to 20 mm.

41. A cooking vessel for use in a microwave oven, comprising a bottom portion and side walls, at least the bottom portion being made of a microwave transparent material, and means for modifying a microwave field pattern to which the vessel is exposed to cause at least one mode of microwave energy of higher order than the fundamental modes of said energy to propagate in a substance supported on an upper surface of said bottom portion to provide by means of such higher order mode a significant portion of the heating of said substance, said means extending across said bottom portion spaced a distance beneath said upper surface of said bottom portion measured in millimeters of at least 3 divided by the square root of the dielectric constant of said bottom portion.

42. A vessel according to claim 41, wherein said distance is between about 3 and 10 mm.

43. A cooking vessel for use in a microwave oven, comprising a bottom portion defining a inside bottom surface and side walls of microwave transparent material and a metallised layer extending at least across said bottom portion, said layer having apertures therein to provide means for generating a microwave field pattern having at least one mode of microwave energy of higher order than the fundamental modes of such energy in said vessel, said means being spaced from the inside bottom surface by a distance measured in millimeters of at least 3 divided by the square root of the dielectric constant of said bottom portion.

44. A vessel according to claim 43, wherein said layer extends up the side walls.

45. In a method of heating a substance by microwave energy, the steps of (a) confining said substance in a container such that at least some of the energy enters the substance through an undersurface thereof, and (b) at a location beneath said undersurface modifying the microwave field pattern to cause at least one mode of microwave energy of higher order than the fundamental modes of such energy to propagate in said substance to provide by means of such higher order mode a significant portion of the heating of such substance, to improve the uniformity of heating of said substance, said location being spaced a distance beneath said undersurface measured in millimeters of at least 3 divided by the square root of the dielectric constant of the medium in such space.

46. The method of claim 45, wherein the majority of all the microwave energy enters the substance through said undersurface.

47. The method of claim 45, wherein said undersurface is flat and said predetermined distance is uniform.

48. In a method of heating a substance by microwave energy, the steps of (a) confining said substance in a container such that at least some of the energy enters the substance through an undersurface thereof, and (b) at a location between one-fifteenth and one-sixth of the wavelength of the microwave energy in the medium between said location and said undersurface beneath said undersurface modifying the microwave field pattern to enhance the coupling of microwave energy into said undersurface, (c) wherein said coupling enhancement is achieved by means of a substrate of dielectric material with an array of conductive plates covering at least the majority of the surface areas of said substrate, the substrate and the plates cooperatively providing a dielectric constant greater than 10.

49. A stand for use in a microwave oven having a microwave field pattern for use with a container having at least one portion including a bottom portion transparent to microwave energy, on which bottom portion there is supported an undersurface of a substance to be heated, said stand comprising (a) means for modifying said microwave field pattern to cause at least one mode of microwave energy of higher order than the fundamental modes of such energy to propagate in such substance to provide by means of such higher order mode a significant portion of the heating of said substance, and (b) means for supporting the container spaced above said modifying means with a medium between the container and said modifying means and with said undersurface a distance above said field modifying means measured in millimeters of at least 3 divided by the square root of the dielectric constant of said medium.

50. In combination (a) a container for use in a microwave oven having a microwave field pattern, said container having at least one portion including a bottom portion transparent to microwave energy, on which bottom portion there is supported an undersurface of a substance to be heated, and (b) a stand for such container comprising means for modifying said microwave field pattern, to cause at least one mode of microwave energy of higher order than the fundamental modes of said energy to propagate in said substance to provide by means of such higher order mode a significant portion of the heating of said substance, and means for spacing said container bottom above said modifying means with a medium between the container and said modifying means and with said undersurface a distance above said modifying means measured in millimeters of at least 3 divided by the square root of the dielectric constant of said medium.

* * * * *